United States Patent [19]

Feucht et al.

[11] Patent Number: 4,653,229

[45] Date of Patent: Mar. 31, 1987

[54] HOLDING INSTALLATION FOR DOUBLE DOORS

[75] Inventors: Fritz Feucht, Renningen; Karl Mettenleiter, Weil der Stadt; Ralf Storandt, Leonberg, all of Fed. Rep. of Germany

[73] Assignee: GEZE GmbH, Leonberg, Fed. Rep. of Germany

[21] Appl. No.: 678,820

[22] Filed: Dec. 6, 1984

[30] Foreign Application Priority Data

Feb. 22, 1984 [DE] Fed. Rep. of Germany ..... 3406433

[51] Int. Cl.[4] ..... E05C 7/06

[52] U.S. Cl. ..... 49/367; 16/58; 16/62; 49/29

[58] Field of Search ..... 49/367, 368, 369, 366, 49/30, 29; 16/58, 62, 51

[56] References Cited

U.S. PATENT DOCUMENTS

| | | | |
|---|---|---|---|
| 3,574,886 | 4/1971 | Solovieff | 16/58 X |
| 3,895,461 | 7/1975 | Maynard, Jr. et al. | 49/367 |
| 4,080,687 | 3/1978 | Jentsch | 16/62 X |
| 4,146,994 | 4/1979 | Williams | 49/367 |
| 4,234,996 | 11/1980 | Jentsch | 16/62 X |
| 4,414,703 | 11/1983 | Schnarr et al. | 16/62 X |
| 4,583,324 | 4/1986 | Storz et al. | 49/367 |

*Primary Examiner*—Philip C. Kannan

[57] ABSTRACT

A holding installation with an integrated closing sequence regulation is described for double doors comprising a leading door which is the first to close and a trailing door which then closes. The hydraulic door closer associated with the trailing door is provided with a signal generating device which is actuated in dependence on the piston position, and with an additional return flow passage for hydraulic fluid. The signal generating device controls the solenoid valve which holds the leading door by preventing the movement of hydraulic fluid contained in the door closer for the leading door, thus preventing movement of the associated piston.

9 Claims, 5 Drawing Figures

HOLDING INSTALLATION FOR DOUBLE DOORS

Figure 1:
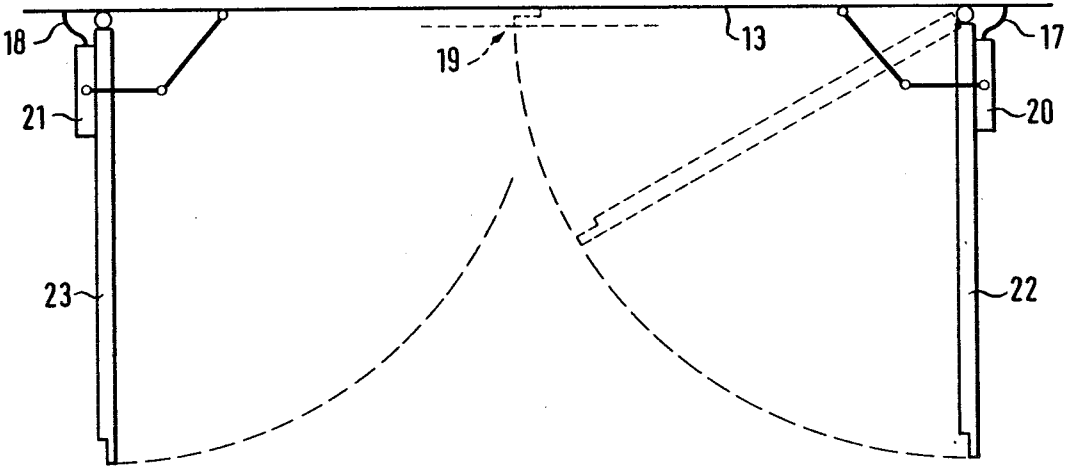

The invention relates to a holding installation for double doors having an integrated closing sequence regulator.

It is known with double doors, comprising a leading door which is the first to close and a trailing door which subsequently closes, to provide a closing sequence regulator which ensures that the leading door always moves into the closed position before the trailing door, and thus ensures that the overlapped leading door always comes to lie behind the overlapping trailing door relative to the door frame and thus that an orderly closing sequence is present.

Closing sequence regulators are already known, in addition to the known mechanical closing sequence regulators, in which respective hydraulically damped door closers are attached to both the leading door and to the trailing door with the door closer provided at the trailing door being so controlled in dependence on the operating position of the leading door that the trailing door can only be brought into the closed position by its associated closer when the leading door has, at least substantially, already reached its closed position. In this arrangement the closer associated with the trailing door is preferably provided with an integrated valve which is responsible for the closing sequence regulation. For this reason one can also term a door closer of this kind with hydraulic damping as a closer with integrated closing sequence regulation.

The requirement frequently arises in connection with double doors that the two doors, namely the leading door and the trailing door can be fixed at specific angles of opening so as to enable unhindered passage during normal working hours. For such installations it must however also be ensured that automatic closing of the leading and trailing doors can take place either intentionally or in particular in the event of a fire.

Hydraulic door closers are known which are provided with an electrically controlled valve which makes it possible to block the associated closer in particular opened positions, in particular at angles of opening greater than 30°, i.e. to prevent closing of the door by the door closers. Furthermore, electrohydraulic door closers of this kind are known which, as a result of the use of a special electromagnetically actuated valve, which can also be termed step-change valves, enable so-called forcing of the fixed doors by hand. If a door is held in one position it can be pressed closed by hand, despite the electromagnetically achieved holding thereof, because in this case it is possible to overcome the solenoid valve which blocks a flow passage and thereafter the closer returns the door to the closed position.

The problem underlying the present invention is now to provide a door holding installation with an integrated closing sequence regulator which ensures a troublefree closing sequence under all circumstances, and indeed also in the case in which one door is released from the held position by hand. Moreover, the installation should permit the trailing door to be held in place while the leading door is closed, should have an optically pleasing appearance without disturbing projecting parts or complicated additional devices, and should be capable of functioning even if the power supply fails, in particular in the case of fires.

This problem is solved, in connection with an arrangement wherein both the leading door and trailing door are provided with a respective electrohydraulic door closer, in that the closer associated with the trailing door which is already equipped with an integrated closing sequence regulator is additionally provided with a signal generator, which is actuated in dependence on the piston position, and an additional return flow passage which is disposed in the range of movement of the piston; and in that the signal generator controls the electromagnetic holding of the leading door in such a way that the holding of the leading door is released when a signal occurs.

Thus, according to the present invention there is provided a holding installation for double doors comprising a leading door which is the first to close and a trailing door which then closes, wherein each door is provided with an electro-hydraulic door closer and wherein the closing sequence is regulated by devices integrated in the trailing door in dependence on the prevailing position of the leading door, characterised in that the closer for the trailing door is provided with a signal generator, in that this signal generator controls the electromagnetic holding of the closer for the leading door; and in that the piston of the closer for the trailing door can only be blocked over part of its range of movement, which starts from the closed position, in dependence on the instantaneous position of the leading door.

The blocking of the piston of the closer for the trailing door over a part of its range of movement conveniently takes place via an integrated valve which is controlled into the closed position when the leading door is open, in particular via a Bowden cable.

In a particularly advantageous arrangement the signal generator consists of a permanent magnet provided on the piston and a reed switch.

The solenoid operated valves of the two closers are preferably supplied with electrical energy in parallel from a common feed source, and the reed switch is inserted in the feed line for the solenoid of the leading door.

The solenoid operated valves used to block the two closers are advantageously step-change valves.

A particularly preferred embodiment of a holding installation in accordance with the present teaching is characterised in that the pressure fluid chambers on the two sides of the piston of the closer for the trailing door are connected with one another via an overflow passage in which there is inserted the valve which is controlled in dependence on the leading door and the solenoid operated valve which brings about the holding function; and in that a further passage which is connected with a bore in the pressure fluid cylinder opens between the two valves, with the position of the bore being determined in dependence on the desired waiting position of the piston in the course of a closing control sequence initiated by forcing of the trailing door.

It is particularly advantageous if each solenoid valve is arranged coaxial to the piston bore of the associated door closer.

The passage which opens into the overflow passage between the integrated valve and the solenoid operated valve is conveniently divided into two bores and leads in the sense of a T-branch to the solenoid valve and to the integrated valve which ensures the integrated closing sequence control.

Figure 2:
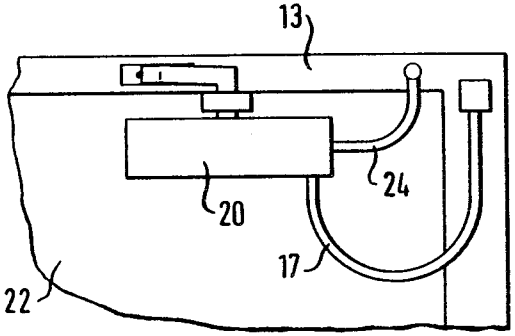
Figure 3:
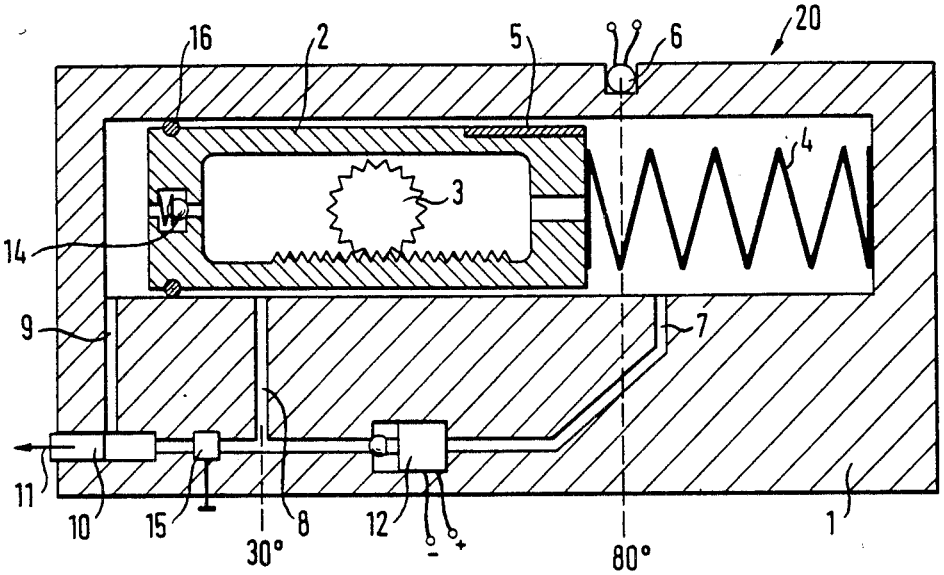
Figure 4:
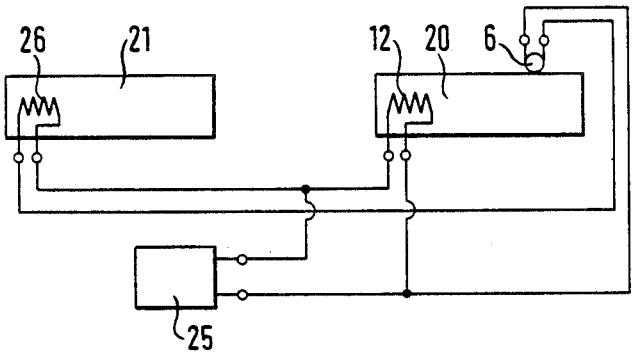
Figure 5:
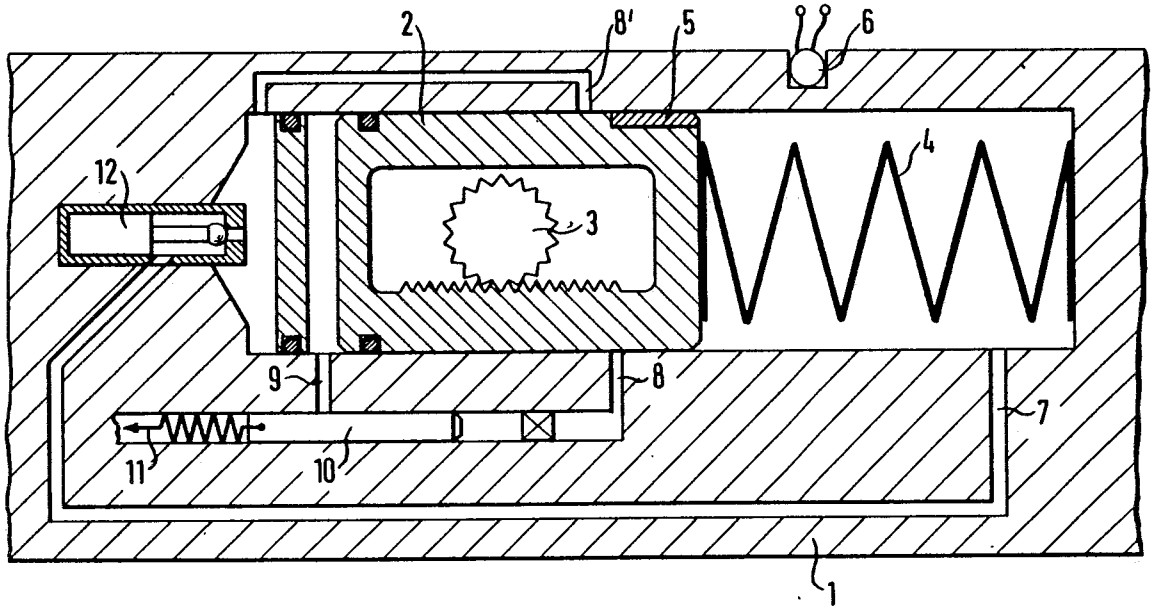

The invention will now be described in detail in the following with reference to the drawing which shows:

FIG. 1 a schematic illustration of a double-door installation,

FIG. 2 a schematic illustration of an electrohydraulic door closer with an integrated closing sequence regulator mounted on the trailing door of the double doors of FIG. 1, FIG. 3 a schematic illustration of the principle of operation of an electrohydraulic door closer with an integrated closing sequence regulator and additional signal generating and fluid control means necessary for the arrangement of the present invention, FIG. 4 a schematic illustration of the electrical wiring of the closers associated with the leading and trailing doors, and FIG. 5 a schematic illustration of an embodiment of the arrangement of FIG. 3.

FIG. 1 shows a double door having a leading door 23 and a trailing door 22. An electrohydraulic door closer 21 is provided at the leading door 23, i.e. a door closer which can be secured at various opened positions via an electromagnetically actuatable valve.

The trailing door 22 is equipped with an electrohydraulic door closer 20 which contains an integrated closing sequence regulator. Both door closers obtain their power supply via lines 17, 18. The two doors 22, 23 are shown in broken lines in the closed position in which the underlapping/overlapping arrangement 19 can be seen.

FIG. 2 shows the mounting of the closer 20 on the trailing door 22 and the securing of the closer arm to the door frame 13. A supply line 17 serves to supply current to the door closer 20 whereas a Bowden cable 24 is used to control the integrated closing sequence valve, as for instance disclosed in assignee's co-pending Application Ser. No. 627,661 filed July 3, 1984, now U.S. Pat. No. 4,583,324, issued Apr. 22, 1986 which is hereby included by reference. The two lines 17, 24 can also be combined.

FIG. 3 shows in schematic manner the construction of the door closer 20 provided for the trailing door 22, with the door closer 20 having an integrated closing sequence regulator and control means for intentionally influencing the behavioural movement of the door closers provided at the leading and trailing doors, in particular in the event that the trailing door is forced.

A cylindrical bore is provided in the housing 1 of the door closer to accommodate a piston 2 which, via appropriate gearing actuates a pinion 3 which is connected to the shaft of the door closer. The piston 2 is acted on by a closing spring 4 and moves in the cylindrical housing bore. On opening the door the closing spring is compressed and the door is closed as the closing spring relaxes.

A suction valve 14 ensures that pressure fluid, in particular oil, is always present in the chamber to the left of the piston 2. On closing the door as a result of the operation of the closing spring 4 the valve 14 is closed and the oil is forced via overflow passages into the chamber to the right of the piston.

Three mutually displaced oil discharge bores, namely the bores 7, 8, 9 lead out of the cylinder chamber. A valve 10 which is movable to and fro between an open position and a closed position is arranged in the overflow passage from the bore 9 to the bore 7 with the direction of movement of the valve being indicated by the arrow 11. This valve 10 is preferably controlled via the Bowden cable 24 shown in FIG. 2 in dependence on the instantaneous position of the leading door.

Furthermore, a solenoid valve 12 which is controllable is arranged in the passage between the oil discharge bores 9 and 7 and, in the closed state, prevents the flow of oil in the overflow passage and in this way prevents movement of the piston 2 and thus closing of the door. Starting from the oil discharge bore 8 a further passage extends to the overflow passage between the bores 8 and 9. The oil discharge bore 8 is preferably arranged in such a way that its position related to the piston corresponds to an open angle of the door of approximately 30°.

The piston 2 is equipped with a permanent magnet 5 which cooperates with a reed switch 6 mounted in the housing of the door closer.

The manner of operation of the arrangement will now be explained considering first of all simply the opening of the trailing door and then the closing of the trailing door and of the leading door.

On opening the trailing door 22 the valve 10 of FIG. 3 is in the position in which it is drawn towards the left, i.e. the oil discharge bores 8 and 9 are connected with one another. The quantity of oil flowing through the passages can be adjusted by a regulating valve 15. If the doors are opened by less than 30° then they close again automatically because the piston 2 forces the oil through the bores 9, 8 via the piston ring 16, i.e. it is not possible to secure the door at angles of opening less than 30°.

If the door is to be held open it must be opened by an angle of more than 30°. In this case the piston ring 16 is located in the region between the bores 7, 8. The solenoid valve 12, which is normally supplied with current for the purpose of holding the door, is closed and the piston cannot move in the closing direction, i.e. the spring 4 cannot relax. Accordingly the door can be fixed at any desired angle above 30° without problem.

If the door is to be closed it can be drawn to or pushed to by hand. In so doing the solenoid valve 12, which preferably has a stepped piston is opened by the pressure that is created and remains in the opened state. The closer then closes, i.e. the door shuts. The use of a step-change valve ensures that the magnetic valve 12 automatically remains open in the closing phase.

In the same manner closing of the door is achieved when the electrically operated solenoid valve 12 is switched off, which can take place from a smoke signalling post. It can be seen that the trailing door operates independently of the leading door as with a customary electrohydraulic door closer with a holding device. The case of simultaneous opening of the trailing door 22 and of the leading door 23 will now be described.

The leading door 23 can for example be held at an angle of opening of 90° because the associated door closer 21 is likewise equipped with an electromagnetically actuatable holding device such as is described above.

The holding of the door takes place via a solenoid valve 12 as shown in FIG. 3.

If the leading door 23 is opened then the valve 10 in the closer 20 of the trailing door 22 is closed via the Bowden cable 24. The trailing door 22 can, independently of this valve 10, likewise be held in position, for example at an angle of opening of 90°. The piston ring 16 of the piston 2 of this door closer 20 then lies between the bores 7, 8. An oil discharge is however not possible in this position because the solenoid valve 12 is closed as a result of the holding operation that has been selected.

Closing of the leading door 23 on its own would be possible without problem via the solenoid valve located in the door closer because this solenoid valve would only have to be opened in order to ensure closing of the leading door. This closing of the leading door is also unproblematic because a closing sequence regulator has no roll to play during this process and does not therefore have to enter into action.

The closing sequence regulator must however come into effect on closing of the trailing door 22. If the trailing door 22 is pulled to or pressed to by hand, then the solenoid valve 12 releases, as a result of the pressure that is created, as already described in connection with opening of the trailing door alone, and the door closer moves to the closed position.

At an angle of opening of the door of approximately 80° (see FIG. 3) the closer 20 provided on the trailing door 22 however switches off the solenoid in the door closer 21 of the trailing door via the reed switch 6 which is actuated by the control magnet 5 in the piston 2, i.e. the signal generated by the reed switch opens the solenoid valve in the door closer 21 of the leading door 23. Accordingly, the leading door 23 is likewise released and closes during closing of the trailing door 22 when the latter has reached an angle of opening of approximately 80°.

The trailing door 22 can however only close as far as the bore 8 and must remain stationary in this position because the connection 8, 9 is closed via the valve 10 which is still in the closed state. The consequence of this is that the trailing door 22 has to wait until the leading door 23, which is now closing, has been practically completely closed. The valve 10 is first opened via the Bowden cable 24 when the leading door 23 has almost reached its closed position and the trailing door can now likewise move into the closed position from its waiting position at an angle of opening of approximately 30°.

This arrangement ensures that the door can also be released by hand, that the release of the trailing door also releases the leading door and that the correct closing sequence regulation is ensured by the waiting of the trailing door.

The position of the reed switch 6 can, in accordance with the invention, be varied and it is also possible to use at least one further additional pair of permanent magnet and reed switch.

FIG. 4 schematically shows the electrical wiring for the door closers 20, 21. A power supply 25, which is switched off in the case of fire, supplies both closers with current in parallel. The wiring of the reed switch 6 is likewise indicated. This reed switch 6 must be closed when the door closer 20 is located in a position beyond 80° of opening. It can also be seen from the wiring arrangement of FIG. 4 that the two solenoids 12 and 26 of the two door closers are connected in series, with the reed switch 6 however lying in the feed line to the solenoid 26 at the leading door side so that it can interrupt the power supply in the manner already mentioned.

The embodiment shown in FIG. 5 corresponds essentially to the embodiment of FIG. 3 and corresponding reference numerals have also been used to characterise the individual parts.

The solenoid valve 12 is located in this embodiment in the actual piston bore of the door closer. This is a preferred solution because the solenoid 12 can in this case be accommodated in a particularly favourable manner.

The bore 8 disposed between the two oil discharge bores 7 and 9 is split in the embodiment of FIG. 5 into bores 8 and 8' and it leads, in the sense of a T-branch as in the case of FIG. 3, to the solenoid valve 12 and to the valve 10 which ensures the integrated closing sequence regulation. The flow of oil and the manner of operation correspond to the arrangement of FIG. 3.

The angles of opening of 30° and 80° mentioned in the above description are merely by way of example. Other angles, for example 80° and 60° or 70° and 40° are possible in the same manner. However the above described principle of cooperation is present in the same manner for all embodiments.

It should also be pointed out that the manner of actuation of the solenoid valves and of the valve for the integrated closing sequence regulation have only been given by way of example, and that other mechanical means of actuation, for example via rods, or electrical and electromagnetic actuation are also possible. The holding of the piston need not necessarily take place via valves, it can also be realised mechanically.

The step change valves referred to herein are valves which require a relatively large force to unseat them but which can be held open by a relatively smaller force. Thus, after forcing of a door the door is able, assuming the closing sequence regulator permits it, to close under the force of the spring embodied in the associated door closer which is sufficient to hold the valve off its seat.

We claim:

1. A door holding and closing installation for double doors comprising a leading door which is the first to close and a trailing door which then closes, the installation including:

a first electro-hydraulic door closer for said leading door, for moving said leading door into a closed position, said first door closer including a first electrically actuated holding device for holding said leading door in a selected open position;

a second electro-hydraulic door closer for said trailing door, for moving said trailing door into a closed position, said second door closer including a second electrically actuated holding device for holding said trailing door in a selected open position, said second holding device being capable of being manually overridden by pushing said trailing door in the closing direction;

blocking means associated with said second door closer and actuated in dependence on a position of said leading door for blocking the closing movement of the trailing door over a part only of its range of movement, said blocking means ensuring closing sequence control and said part of said range of movement starting from said closed position of said trailing door; and switch means associated with said second door closer, said switch means being actuated at a selected angle of opening of said trailing door to release said first electrically actuated holding device whereby said leading door closes and frees said blocking means to permit closing of said trailing door.

2. A door holding and closing installation in accordance with claim 1, wherein said second door closer comprises a housing, a door closer shaft, a cylindrical bore in said housing, a piston movable in said cylindrical bore and connected to said door closer shaft, whereby movement of said piston results in movement of said door closer shaft, first and second chambers in said cylindrical bore on respective sides of said piston, a spring disposed in said first chamber and acting on said piston to urge it in a door closing direction, a passage connecting said first chamber with said second chamber, whereby closing movement of said piston forces hydraulic fluid to flow through said passage, wherein a valve is disposed in said passage and is movable between an open position in which hydraulic fluid may flow through said passage and a closed position in which the flow of hydraulic fluid through said passage is prevented, and wherein said valve defines said blocking means and is moved into said closed position when the leading door is open.

3. A door holding and closing installation in accordance with claim 2, wherein said blocking means further comprises a Bowden cable connected to move said valve into said closed position.

4. A door holding and closing installation in accordance with claim 2, wherein said switch means comprises a permanent magnet provided on said piston and a reed switch associated with said housing.

5. A door holding and closing installation in accordance with claim 4, wherein said second holding device comprises a solenoid operated valve disposed to prevent flow of said hydraulic fluid from said second chamber to said first chamber; wherein said first holding device comprises a similarly disposed solenoid operated valve for said first door closer; wherein said solenoid operated valves of said first and second door closers are supplied with electrical energy in parallel from a common feed source; and wherein said reed switch is inserted in the feedline for said solenoid operated valve for said first closer.

6. A door holding and closing installation in accordance with claim 5, wherein said solenoid operated valves comprise step change valves which require a relatively large force to unseat them but which can be held open by a relatively smaller force.

7. A door holding and closing installation in accordance with claim 5, wherein said solenoid valve for said second door closer is provided in said passage; and wherein a further passage is provided in said housing and is connected with said cylindrical bore and with the first said passage between said blocking valve and said solenoid valve associated with said second door closer; and wherein the position at which said further bore opens into said cylindrical bore is determined in dependence on the desired waiting position of said piston in the course of a closing control sequence initiated by pushing said trailing door in the closing direction.

8. A door holding and closing installation in accordance with claim 5, wherein each said solenoid valve is arranged coaxial to the cylindrical bore of the associated door closer.

9. A door holding and closing installation in accordance with claim 8, wherein said further passage which opens in the overflow passage between said blocking valve and said solenoid operated valve of said second door closer is divided into two bores and leads in the sense of T branch to the last said solenoid valve and to said blocking valve which ensures said integrated closing sequence control.

* * * * *